US011428405B2

(12) United States Patent
Bijkerk et al.

(10) Patent No.: US 11,428,405 B2
(45) Date of Patent: Aug. 30, 2022

(54) HYDROGEN GAS BURNER

(71) Applicant: AMF Den Boer B.V., Bunschoten-Spakenburg (NL)

(72) Inventors: Remco Bijkerk, Diepenveen (NL); Philip J. Domenicucci, Rockaway, NJ (US)

(73) Assignee: AMF DEN BOER B.V., Spakenburg (NL)

( * ) Notice: Subject to any disclaimer, the term of this patent is extended or adjusted under 35 U.S.C. 154(b) by 0 days.

(21) Appl. No.: 17/361,367

(22) Filed: Jun. 29, 2021

(65) Prior Publication Data

US 2021/0404655 A1 Dec. 30, 2021

Related U.S. Application Data

(60) Provisional application No. 63/045,359, filed on Jun. 29, 2020.

(51) Int. Cl.
*F23D 14/02* (2006.01)
*F23D 14/62* (2006.01)
(Continued)

(52) U.S. Cl.
CPC ..... *F23D 14/62* (2013.01); *F23D 14/02* (2013.01); *F23D 14/22* (2013.01); *F23Q 3/008* (2013.01);
(Continued)

(58) Field of Classification Search
CPC .... F23D 14/62; F23D 14/22; F23D 2203/007; F23Q 3/008; F23N 2239/04
(Continued)

(56) References Cited

U.S. PATENT DOCUMENTS 1,916,983 A * 7/1933 McKee ..... F23D 14/32 239/412
2,294,748 A 9/1942 Hanson
(Continued)

FOREIGN PATENT DOCUMENTS

WO 2011062513 A1 5/2011
WO 2012143738 A2 10/2012
(Continued)

OTHER PUBLICATIONS

Int'l Search Report and Written Opinion dated Oct. 11, 2021 in Int'l Application No. PCT/IB2021/05579.

*Primary Examiner* — Avinash A Savani
(74) *Attorney, Agent, or Firm* — Panitch Schwarz Belisario & Nadel LLP

(57) ABSTRACT

The hydrogen gas burner has a first pipe extendable into an oven chamber, having a plurality of through-holes in a sidewall thereof, fluidly communicating an interior of the first pipe with an exterior thereof. A combination gas valve and pressure regulator is connected to an inlet of the first pipe and fluidly connects a hydrogen gas source with the first pipe, such that the hydrogen gas flows into the first pipe and exits therefrom through the through-holes. An igniter ignites and initiates combustion of the exiting hydrogen gas. A second pipe is extendable into the oven chamber, having apertures in the sidewall thereof fluidly communicating an interior of the second pipe with an exterior thereof. The second pipe fluidly connects at an inlet thereof with an air source, whereby the air flows into the second pipe from the inlet thereof and exits out of the second pipe through the apertures.

20 Claims, 11 Drawing Sheets

(51) Int. Cl.
*F23D 14/22* (2006.01)
*F23Q 3/00* (2006.01)

(52) U.S. Cl.
CPC .... *F23D 2203/007* (2013.01); *F23N 2239/04* (2020.01)

(58) Field of Classification Search
USPC ..... 431/264, 52
See application file for complete search history.

(56) References Cited

U.S. PATENT DOCUMENTS 2,494,243 A 1/1950 Houlis
2,707,519 A * 5/1955 Strobel ..... F23N 5/067 431/43
3,172,460 A 3/1965 Temple
4,421,474 A 12/1983 Meyer
4,465,455 A 8/1984 Meyer
4,702,693 A * 10/1987 Fraioli ..... F26B 17/20 126/92 R
5,435,343 A 7/1995 Buezis
5,735,503 A 4/1998 Hietkamp
6,267,585 B1 7/2001 Suttrop
6,302,143 B1 10/2001 Sarlak
7,677,884 B2 3/2010 Kaupert et al.
8,669,499 B2 3/2014 Conrad
8,734,632 B1 5/2014 Eisman
8,840,942 B2 9/2014 Olver et al.
9,739,482 B2 8/2017 Colin et al.
10,066,838 B2 9/2018 Deng
10,208,958 B2 2/2019 Carroni et al.
10,627,107 B2 4/2020 Hirata et al.
10,648,662 B2 5/2020 Maitani et al.
2003/0213484 A1 11/2003 Alden et al.
2006/0032930 A1 * 2/2006 Glidden ..... F23N 5/184 236/1 E
2010/0024799 A1 2/2010 Conrad
2015/0245741 A1 * 9/2015 Fechter ..... A47J 37/0713 426/523
2018/0119954 A1 5/2018 Fu
2018/0224122 A1 8/2018 Mimura
2019/0056107 A1 2/2019 Desai et al.
2019/0072273 A1 3/2019 Hirata et al.

FOREIGN PATENT DOCUMENTS

WO 2013024783 A1 2/2013
WO 2017136489 A1 8/2017
WO 2019032068 A2 2/2019

* cited by examiner

HYDROGEN GAS BURNER

CROSS-REFERENCE TO RELATED APPLICATION

This application claims priority from U.S. Provisional Patent Application No. 63/045,359, titled "Hydrogen Gas Burner", filed on Jun. 29, 2020, the entire contents of which are incorporated by reference herein.

BACKGROUND OF THE DISCLOSURE

The disclosure relates to a hydrogen gas burner for direct, indirect or hybrid fired ovens.

Conventional direct fired pipe ribbon burners for an oven, e.g., a commercial/industrial oven, generally operate on the combustion of natural gas. Byproducts of natural gas combustion do not contaminate the food products. One drawback of the combustion of natural gas to generate heat, however, is the accompanying emissions, such as, for example, carbon emissions in the form of carbon monoxide and carbon dioxide, as well as other gases. Moreover, supplying burners with natural gas involves obtaining, transporting, sourcing, and refining steps that require energy, which also results in emissions, such as carbon emissions.

It would, therefore, be advantageous to manufacture a burner for an oven or grill that utilizes a greener source of energy without sacrificing the quality of the food product, e.g., a fuel other than natural gas for combustion, such as hydrogen gas, which results in reduced emissions, e.g., reduced carbon footprint, upon combustion. Byproducts of hydrogen combustion also do not contaminate food products.

BRIEF SUMMARY OF THE DISCLOSURE

Briefly stated, one aspect of the present disclosure is directed to a hydrogen gas burner. The burner has a first pipe extendable into an oven chamber, the first pipe including a plurality of through-holes in a sidewall thereof and along a portion of a length thereof, fluidly communicating an interior of the first pipe with an exterior thereof. A combination gas valve and pressure regulator is connected to an inlet of the first pipe, the combination gas valve and pressure regulator being configured to fluidly connect a source of hydrogen gas with the interior of the first pipe at a predetermined pressure, such that the hydrogen gas flows into the first pipe from the inlet thereof and exits out of the first pipe through the plurality of through-holes. An igniter is configured to provide an electrical spark adjacent at least one of the plurality of through-holes, and, in turn, ignite and initiate combustion of the hydrogen gas exiting from the plurality of through-holes. A second pipe is extendable into the oven chamber, the second pipe having a plurality of apertures along a portion of a length of a sidewall thereof and fluidly communicating an interior of the second pipe with an exterior thereof. The second pipe is configured to fluidly connect at an inlet thereof with a source of air, such that the air flows into the second pipe from the inlet thereof and exits out of the second pipe through the apertures.

In one configuration, the first pipe and the second pipe may be coplanar and extend parallel to one another.

In any of the previous configurations, the second pipe may be positioned on an opposite side of the first pipe from the plurality of through-holes, and the apertures face toward the first pipe.

In any of the previous configurations, the apertures may be coplanar with the plurality of through-holes.

In any of the previous configurations, the apertures may span a length substantially equal to the portion of the length of the first pipe having the plurality of through-holes.

In any of the previous configurations, the second pipe may include a ribbon along the portion of the length of the sidewall thereof, the ribbon defining the apertures.

In any of the previous configurations, at least one of the first pipe and the second pipe may be substantially cylindrical.

In any of the previous configurations, the plurality of through-holes may be arranged in at least one row along the portion of the length of the first pipe.

In any of the previous configurations, the plurality of through-holes may be arranged in a single row along the portion of the length of the first pipe.

In any of the previous configurations, the first pipe may be configured to project between approximately 19.6 inches and approximately 240 inches into the oven chamber.

In any of the previous configurations, at least one of the first pipe and the second pipe may define an internal diameter of between approximately 0.75 inch IPS and approximately 2.0 inches IPS.

In any of the previous configurations, each pair of successive through-holes of the plurality of through-holes may be spaced between approximately 0.12 inch and approximately 0.35 inch apart, on-center.

In any of the previous configurations, each one of the plurality of through-holes may define an internal diameter between approximately 0.008 inch and approximately 0.03 inch.

In any of the previous configurations, the burner may be configured to produce between approximately 450 Btu/in and approximately 2,000 Btu/in of heat.

In any of the previous configurations, the predetermined pressure regulated by the combination gas valve and pressure regulator may be between approximately 2" wc and approximately 24" wc.

In any of the previous configurations, the second pipe may be configured to release between approximately 83.6 $ft^3$/hr and approximately 1,484 $ft^3$/hr of air into the oven chamber.

Another aspect of the present disclosure is directed to a gas burner. The burner includes a first pipe extendable into an oven chamber, the first pipe including a plurality of through-holes in a sidewall thereof and along a portion of a length thereof, fluidly communicating an interior of the first pipe with an exterior thereof. A combination gas valve and pressure regulator is connected to an inlet of the first pipe, the combination gas valve and pressure regulator being configured to selectively, fluidly connect a source of hydrogen gas with the interior of the first pipe at a predetermined pressure to selectively permit the hydrogen gas to flow into the first pipe from the inlet thereof and exit out of the first pipe through the plurality of through-holes. A first igniter is configured to selectively provide an electrical spark adjacent at least one of the plurality of through-holes, and, in turn, selectively ignite and initiate combustion of the hydrogen gas exiting from the plurality of through-holes. A second pipe is extendable into the oven chamber, the second pipe having a ribbon extending along a portion of a length thereof and fluidly communicating an interior of the second pipe with an exterior thereof. A mixing valve is connected to an inlet of the second pipe, the mixing valve being configured to receive air from a source of air, selectively receive a fuel gas from a source of the fuel gas, selectively mix the air and the fuel gas together and selectively, fluidly connect the mixed air and fuel gas with the interior of the second pipe such that the mixed air and fuel gas flows into the second pipe from the inlet thereof and exits out of the second pipe through the ribbon. A second igniter is configured to selectively provide an electrical spark adjacent the ribbon, and, in turn, selectively ignite and initiate combustion of the mixed air and fuel gas exiting from the ribbon.

In one configuration, the second pipe may be positioned on an opposite side of the first pipe from the plurality of through-holes, and the ribbon extends outwardly in a direction away from the first pipe.

In any of the previous configurations, the gas burner may further include a combination gas valve and zero-pressure regulator in fluid communication with an inlet of the mixing valve, the combination gas valve and zero-pressure regulator configured to selectively permit or prohibit flow of the fuel gas from the source of the fuel gas to the mixing valve.

In any of the previous configurations, the fuel gas may take the form of natural gas, a mixed blend of natural gas and hydrogen gas, propane or a mixed blend of propane and hydrogen gas.

Another aspect of the present disclosure is directed to a gas burner. The burner includes a first pipe extendable into an oven chamber, the first pipe including a plurality of through-holes in a sidewall thereof and along a portion of a length thereof, fluidly communicating an interior of the first pipe with an exterior thereof. A combination gas valve and pressure regulator is connected to an inlet of the first pipe, the combination gas valve and pressure regulator being configured to selectively, fluidly connect a source of hydrogen gas with the interior of the first pipe at a predetermined pressure to selectively permit the hydrogen gas to flow into the first pipe from the inlet thereof and exit out of the first pipe through the plurality of through-holes. A first igniter is configured to selectively provide an electrical spark adjacent at least one of the plurality of through-holes, and, in turn, selectively ignite and initiate combustion of the hydrogen gas exiting from the plurality of through-holes. A second pipe is extendable into the oven chamber, the second pipe having a ribbon extending outwardly therefrom along a portion of a length thereof and fluidly communicating an interior of the second pipe with an exterior thereof, the second pipe being rotatable about a central axis thereof between a first position and a second position. In the first position, the ribbon extends outwardly toward the first pipe, and in the second position, the ribbon extends outwardly in a direction away from the first pipe. A mixing valve is connected to an inlet of the second pipe, the mixing valve being configured to receive air from a source of air in the first position of the second pipe and fluidly connect the air with the interior of the second pipe, such that the air flows into the second pipe from the inlet thereof and exits out of the second pipe through the ribbon. The mixing valve is also configured to receive air from the source of air and receive a fuel gas from a source of the fuel gas in the second position of the second pipe, mix the air and the fuel gas together and direct the mixed air and fuel gas into the interior of the second pipe such that the mixed air and fuel gas flows into the second pipe from the inlet thereof and exits out of the second pipe through the ribbon. A second igniter is configured to provide an electrical spark adjacent the ribbon in the second position of the second pipe, and, in turn, selectively ignite and initiate combustion of the mixed air and fuel gas exiting from the ribbon.

In one configuration, the first pipe and the second pipe may be coplanar and extend parallel to one another.

In any of the previous configurations, the plurality of through-holes may be arranged in at least one row along the portion of the length of the first pipe.

In any of the previous configurations, the second pipe may be positioned on an opposite side of the first pipe from the plurality of through-holes.

In any of the previous configurations, the ribbon may be substantially equal in length to the portion of the length of the first pipe having the plurality of through-holes.

In any of the previous configurations, the burner may further include a combination gas valve and zero-pressure regulator in fluid communication with an inlet of the mixing valve, the combination gas valve and zero-pressure regulator being configured to prohibit flow of the fuel gas from the source of the fuel gas to the mixing valve in the first position of the second pipe and configured to permit the flow of the fuel gas from the source of the fuel gas to the mixing valve in the second position of the second pipe.

In any of the previous configurations, the fuel gas may take the form of natural gas, a mixed blend of natural gas and hydrogen gas, propane or a mixed blend of propane and hydrogen gas.

BRIEF DESCRIPTION OF THE SEVERAL VIEWS OF THE DRAWINGS

The following description of embodiments of the disclosure will be better understood when read in conjunction with the appended drawings. It should be understood, however, that the disclosure is not limited to the precise arrangements and instrumentalities shown. In the drawings.

DETAILED DESCRIPTION OF THE DISCLOSURE

Figure 1:
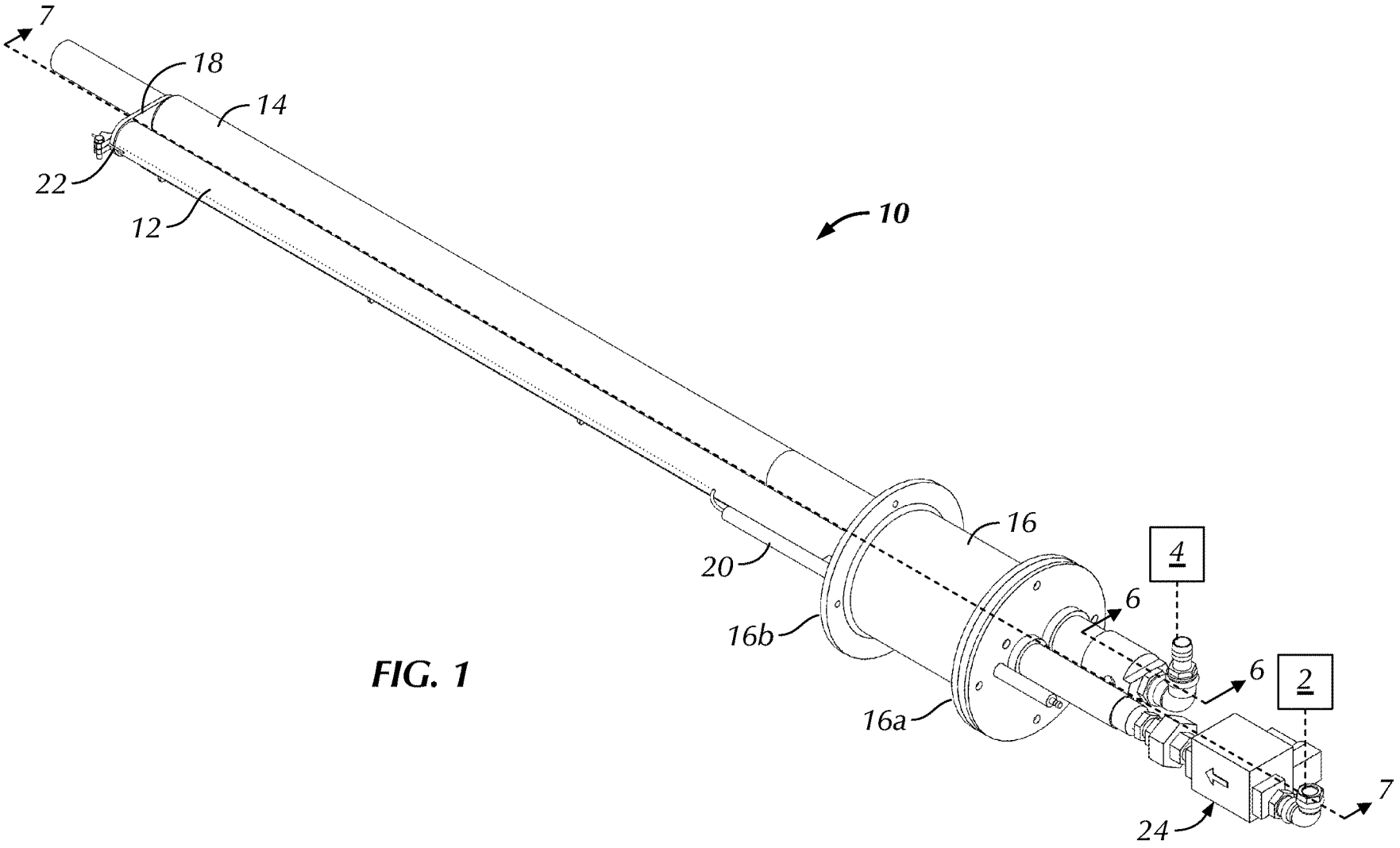
FIG. 1 is a top, front and proximal perspective view of a hydrogen gas burner for use with a direct, indirect or hybrid fired oven, according to a first embodiment of the present disclosure.

Certain terminology is used in the following description for convenience only and is not limiting. The words "lower," "bottom," "upper" and "top" designate directions in the drawings to which reference is made. The words "inwardly," "outwardly," "upwardly" and "downwardly" refer to directions toward and away from, respectively, the geometric center of the burner, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

It should also be understood that the terms "about," "approximately," "generally," "substantially" and like terms, used herein when referring to a dimension or characteristic of a component of the disclosure, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Referring to the drawings in detail, wherein like numerals indicate like elements throughout, there is shown in FIGS. 1-7B a burner 10 for use with a direct, indirect or hybrid fired oven, e.g., a commercial/industrial oven or grill, in accordance with a first embodiment of the present disclosure. The burner 10 includes a first pipe 12 and a second pipe 14. In one configuration, the first and second pipes 12, 14 are substantially cylindrical along the length thereof, i.e., define a generally circular cross-section in a plane perpendicular to the length thereof, but the disclosure is not so limited. Alternatively, one or both of the first and second pipes 12, 14 may define a non-circular cross-section, such as, for example, without limitation, a square, oval, indented, dough folded or square flattened cross-section, a combination thereof along different portions of the length of the pipe(s) or the like. As also should be understood, the first and second pipes 12, 14 may be differently shaped in cross-section from one another. Optionally, one or more of the first and second pipes 12, 14 may be at least partially coated with a high emissivity thermal protective layer, e.g., a nano-emissive coating, such as, for example, as disclosed in U.S. Pat. No. 8,840,942, the entire contents of which are incorporated by reference herein.

In the illustrated embodiment the first and second pipes 12, 14 extend generally parallel with one another and are positioned along the same plane, but the disclosure is not so limited. In the illustrated embodiment, the first and second pipes 12, 14 are of differing lengths, but the disclosure is not so limited. The first and second pipes 12, 14 are secured relative to one another and relative to an oven chamber 1 (shown schematically in FIG. 2) of a direct, indirect or hybrid fired oven (not shown) via a mounting spool pipe 16 proximate a proximal end of the pipes 12 and 14. The mounting spool pipe 16 is generally hollow for the first and second pipes 12, 14 to extend therethrough. In one configuration, mounting plates (not shown) may attach to opposing ends of the mounting spool pipe 16 and include respective apertures (not shown) for each of the first and second pipes 12, 14 to extend therethrough, but the disclosure is not so limited. Each aperture may be generally complementary in dimension to an outer diameter of the corresponding pipe 12, 14, for securement. The first and second pipes 12, 14 may also include at least one bracket 18 positioned distally of the mounting spool pipe 16 and may also be attached to the first and second pipes 12, 14 to secure their relative positioning. As should be understood, however, the first and second pipes 12, 14 may be secured relative to one another and to the mounting spool pipe 16 via other methods currently known or that later become known. As should be understood by those of ordinary skill in the art, the mounting spool pipe 16 extends through, and is secured to, the oven chamber wall (not shown) in a manner well understood by those of ordinary skill in the art. That is, the length of the mounting spool pipe 16 generally corresponds to the thickness of the oven chamber wall and the flanged ends 16*a*, 16*b* of the mounting spool pipe 16 are secured, e.g., fastened, to opposing sides of the wall.

Figure 2:
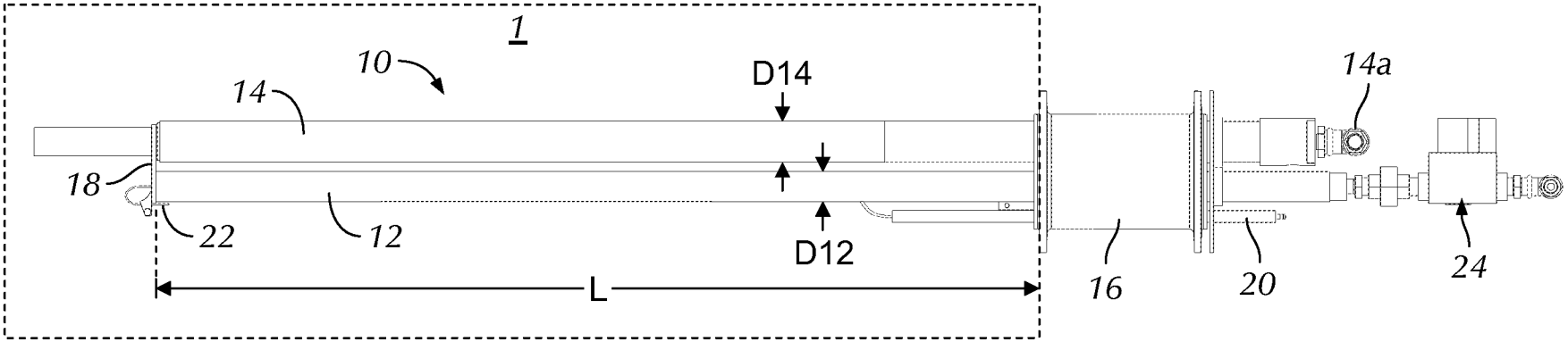
FIG. 2 is a top plan view of the burner of FIG. 1.
Figure 3:
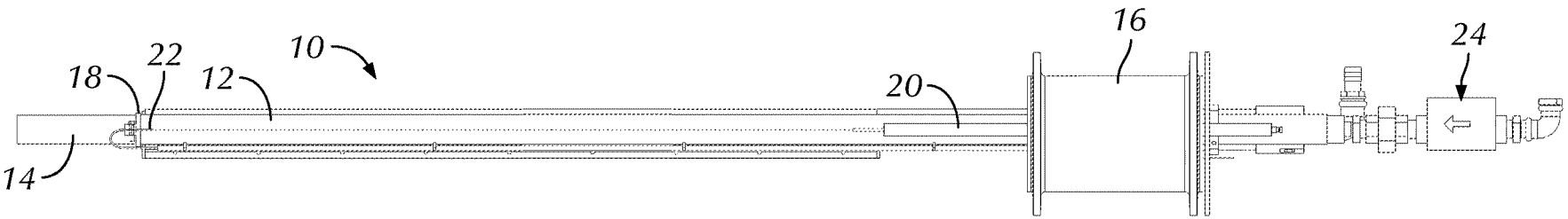
FIG. 3 is a front elevational view of the burner of FIG. 1.

In one embodiment, and as shown in FIG. 2, the first pipe 12 may define an operative length L, i.e., the length of the portion of the first pipe 12 extending into the oven chamber 1, between approximately 500 mm (19.6 inches) and approximately 6,100 mm (240 inches), but the disclosure is not so limited. In one embodiment, the first pipe 12 defines an internal diameter D12 of between approximately 20 mm (0.75 inch IPS, i.e., iron pipe size indicating inside diameter) and approximately 50 mm (2 inches IPS). The first pipe 12 includes a plurality of apertures/through-holes 12*a* in the sidewall of the first pipe 12, e.g., laser or EDM cut, drilled or the like (shown best in FIGS. 3, 4), positioned in series along a portion of the length L thereof, defining the flame space of the first pipe 12.

In one configuration, the plurality of apertures 12*a* are arranged in at least one row of apertures 12*a* positioned along a portion of the length L of the first pipe 12. For example, as shown best in FIGS. 3 and 4, the apertures 12*a* may be arranged in a single row of apertures 12*a*. Alternatively, the more than one row of apertures 12*a* may be employed for increased thermal output of the burner 10, such as, for example, two rows (see FIG. 5). In one configuration, the respective rows may be angularly spaced from one another by between approximately 12° and approximately 15°, such as, for example, by approximately 14°. In one configuration, the apertures 12*a* forming one row may be axially offset, i.e., along the length of the first pipe 12, from the apertures 12*a* forming another row. For example, the apertures 12*a* of one row may each be positioned between two successive apertures 12*a* of the adjacent row(s).

Figure 4:
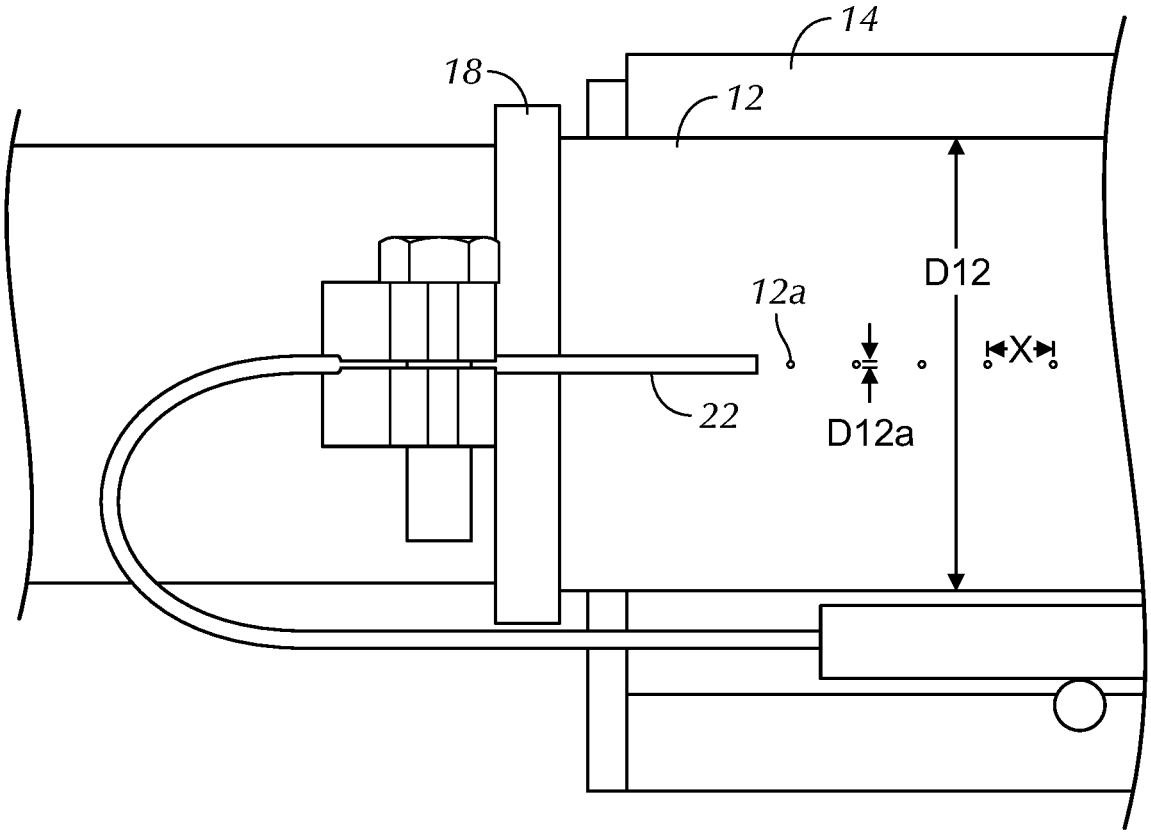
FIG. 4 is an enlarged, partial front elevational schematic view of a distal end of a first pipe of the burner of FIG. 1.
Figure 5:
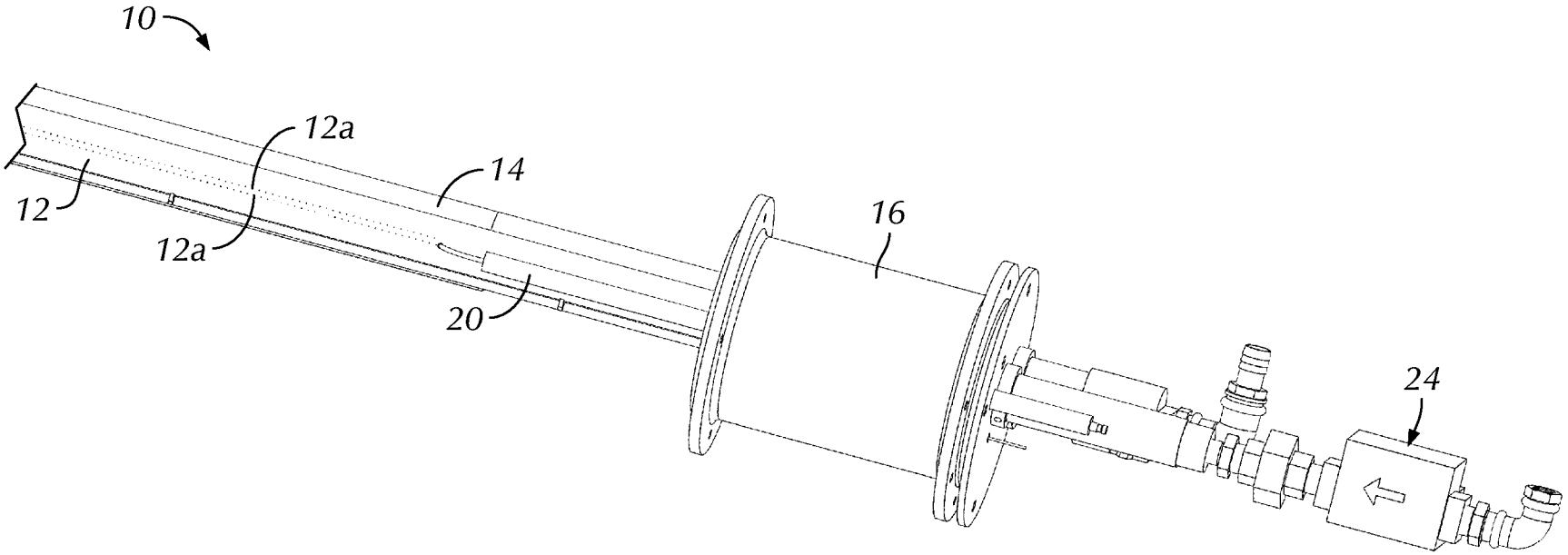
FIG. 5 is a partial perspective view of an alternative configuration of the burner of FIG. 1, employing two rows of apertures along the first pipe.

Referring now to FIG. 4, in one embodiment, each pair of successive apertures 12*a* along a row is spaced a distance X between approximately 3 mm (0.12 inch) and approximately 9 mm (0.35 inch) apart on-center, such as, for example, without limitation, approximately 5 mm (0.2 inch) apart, but the disclosure is not so limited. In one embodiment, each aperture 12*a* defines an internal diameter D12*a* between approximately 0.02 mm (0.008 inch) and approximately 0.76 mm (0.03 inch), such as, for example, without limitation, approximately 0.4 mm (0.016 inch), but the disclosure is not so limited. The plurality of apertures 12*a* are positioned along a horizontal plane extending through both the first and second pipes 12, 14, on a side of the first pipe 12 facing away from the second pipe 14. As should be understood by those of ordinary skill in the art, the operative length L of the first pipe 12, the internal diameter D12 of the first pipe, the spacing X between the apertures 12*a*, the internal diameter D12*a* of the apertures 12*a*, and the size of the oven chamber 1, or a combination thereof, determines the thermal output of the burner 10. In one configuration, the burner 10 is configured to produce between approximately 5.14 kW/m (450 Btu/in) and approximately 22.8 kW/m (2,000 Btu/in) of heat.

As shown best in FIGS. 1-3 and 5, the burner 10 further includes an igniter 20 (controlled via a direct spark ignition (not shown)) connected to, or mounted adjacent to, the first pipe 12 in a manner well understood by those of ordinary skill in the art and configured to provide an electrical spark adjacent one or more of the apertures 12*a* along the first pipe 12. As shown, the igniter 20 extends substantially parallel to the first pipe 12 and is positioned proximate a proximal end of the first pipe 12. In the illustrated configuration (see FIG. 3), the igniter 20 is positioned in the same plane as the apertures 12*a*, but the disclosure is not so limited. Similarly to the first and second pipes 12, 14, the igniter 20 may extend through the mounting spool pipe 16 and may be secured by the mounting plates, but the disclosure is not so limited. As should be understood by those of ordinary skill in the art, the igniter 20 may take the form of a conventional combination igniter and flame detection sensor. Optionally, a conventional opposite side sensor 22 may be attached to a distal end of the first pipe 12, e.g., to the bracket 18, and electrically connected to the direct spark ignition of the burner 10 in a manner well understood by those of ordinary skill in the art.

As also shown in FIGS. 1-3, 5 and 6, a combination gas valve (double valved) and pressure regulator 24, e.g., without limitation, a Honeywell model number VK4105M5215 U gas control with a gas regulator, is connected to an inlet, e.g., at a proximal end, of the first pipe 12. As should be understood by those of ordinary skill in the art, the combination gas valve and pressure regulator 24 selectively fluidly connects a source of combustion fuel/gas 2 (shown schematically in FIG. 1) flowing from a main gas manifold (not shown) with the inlet of the first pipe 12. In the present disclosure, the combustion fuel/gas utilized with the first pipe 12 is hydrogen gas. In one configuration, the combination gas valve and pressure regulator 24 is configured to regulate the hydrogen gas flowing into the first pipe 12 to a pressure between approximately 5 mbar (2" wc, i.e., inches of water column) and approximately 60 mbar (24" wc).

Figure 6:
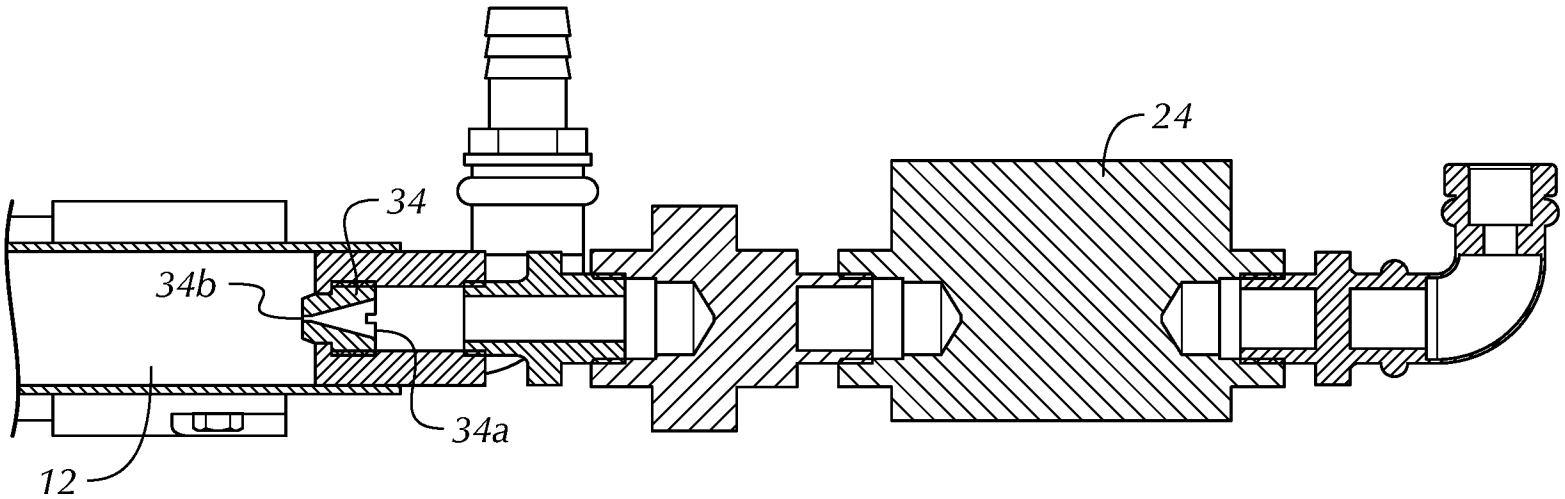
FIG. 6 is a partial, cross-sectional elevational view of the burner of FIG. 1, taken along sectional line 6-6 of FIG. 1.

In one configuration, as shown in FIG. 6, a combustion gas-flow nozzle 34, is fluidly interposed between the combination gas valve and pressure regulator 24 and the first pipe 12 to set the maximum amount of combustion gas entering the first pipe 12. In the illustrated embodiment, the nozzle 34 is sealingly positioned within a proximal end of the first pipe 12. As shown, the nozzle 34 defines an inlet opening 34*a* and an outlet opening 34*b* (according to the direction of flow into the first pipe 12). In the illustrated embodiment, the inner diameter of the combustion gas-flow nozzle 34 generally tapers from a wider inlet opening 34*a* to a narrower outlet opening 34*b*. The diameter of the outlet opening 34*b* is selected relative to the maximum amount of combustion gas required in the first pipe 12 to achieve the intended thermal output of the burner 10. As should be understood by those of ordinary skill in the art, the calibrated diameter of the outlet opening 34*b*, in combination with the pressure of the combustion gas, determines the flow rate of the combustion gas entering the first pipe 12, i.e., according to Bernoulli's equation. In one configuration, the outlet opening 34*b* of the nozzle 34 may define a diameter between approximately 0.019 inch (0.5 mm) and approximately 0.275 inch (7 mm) depending on the maximum flow rate for the particular length of the first pipe 12, such as, for example, without limitation, approximately 0.07 inch (1.8 mm).

In operation, the valves (not shown), e.g., solenoid valves, within the combination gas valve and pressure regulator 24 are opened to allow the flow of hydrogen gas from the hydrogen gas source 2 into the first pipe 12 and the pressure regulator (not shown) within the combination gas valve and pressure regulator 24 regulates the pressure of the hydrogen gas within the first pipe 12. The nozzle 34 sets the maximum flow rate of the hydrogen gas into the first pipe 12. The hydrogen gas then flows out of the apertures 12*a*. The igniter 20 is then actuated to provide the electrical spark which ignites the flame along the apertures 12*a* and initiates combustion of the hydrogen gas exiting from the apertures 12*a*. As should be understood the hydrogen gas combusting, i.e., burning, in the air within the oven chamber 1 of the oven reacts with the oxygen with the air to form moisture, i.e., water vapor, and thermal energy.

Advantageously, hydrogen gas combustion byproducts are free of carbon, and, therefore, carbon emissions are significantly minimized. Additionally, water vapor byproduct of hydrogen gas combustion far exceeds that of natural gas combustion. The relative increase in moisture content within the oven chamber 1, in a controlled manner, may aid in a baking process, such as, for example, with baking of grain-based products, e.g., bread, bagels, pretzels and the like. For example, the increase of moisture content may aid in more efficient heat transfer to the grain-based product, thereby reducing baking time. The increase in moisture content also enables heat to reach the inside of the product sooner, advancing functions such as yeast kill, gelatinization, and arrival time, i.e., dough becomes bread sooner. The moisture may subsequently be extracted (in a manner well understood by those of ordinary skill in the art) at a specific point in the baking process to allow for other objectives, such as product color and crust, to develop. Accordingly, the burner 10 advantageously utilizes a greener source of energy while also producing at least the same or better-quality products.

Figure 7A:
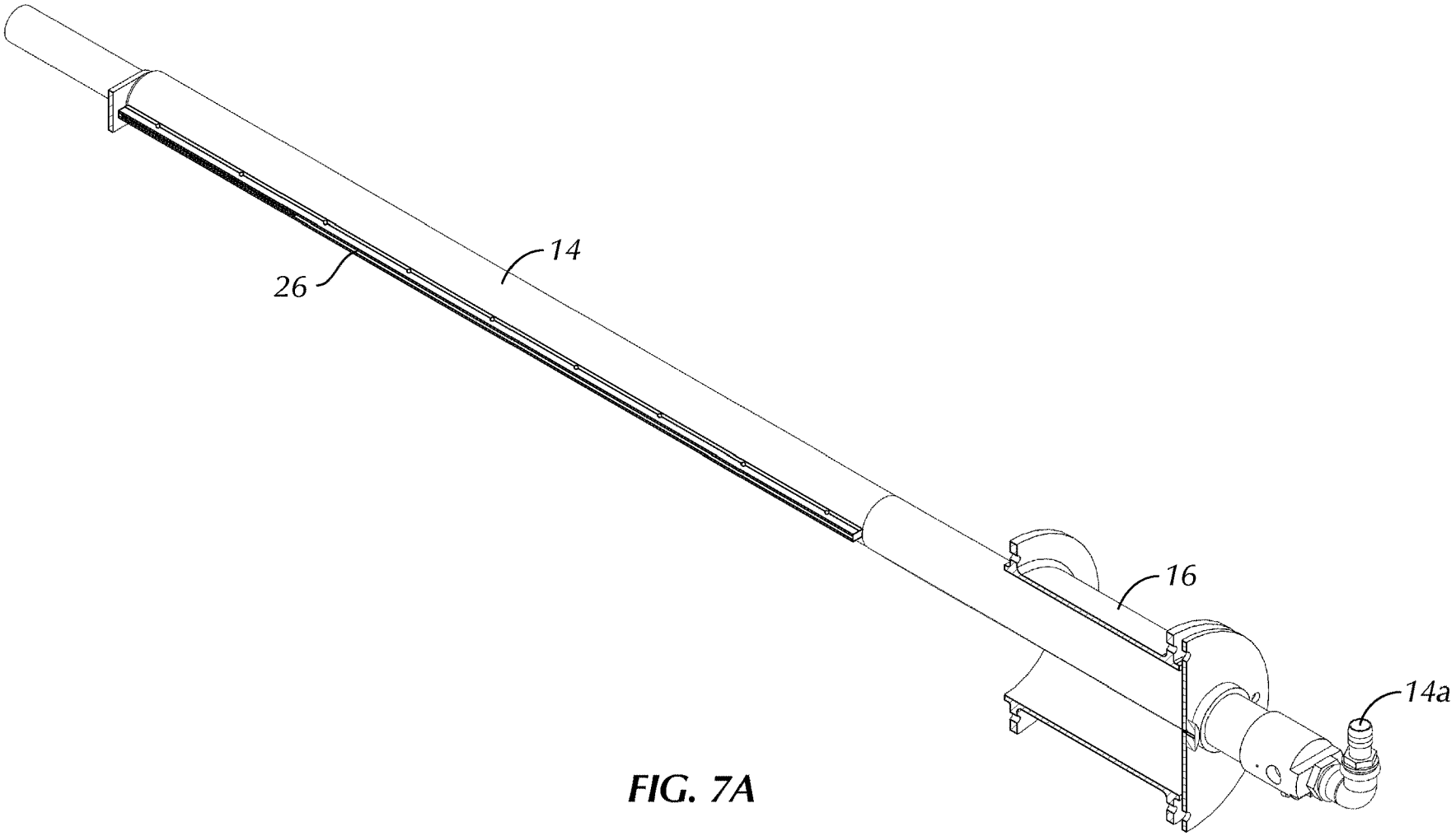
FIG. 7A is a cross-sectional perspective view of the burner of FIG. 1, taken along sectional line 7-7 of FIG. 1.
Figure 7B:
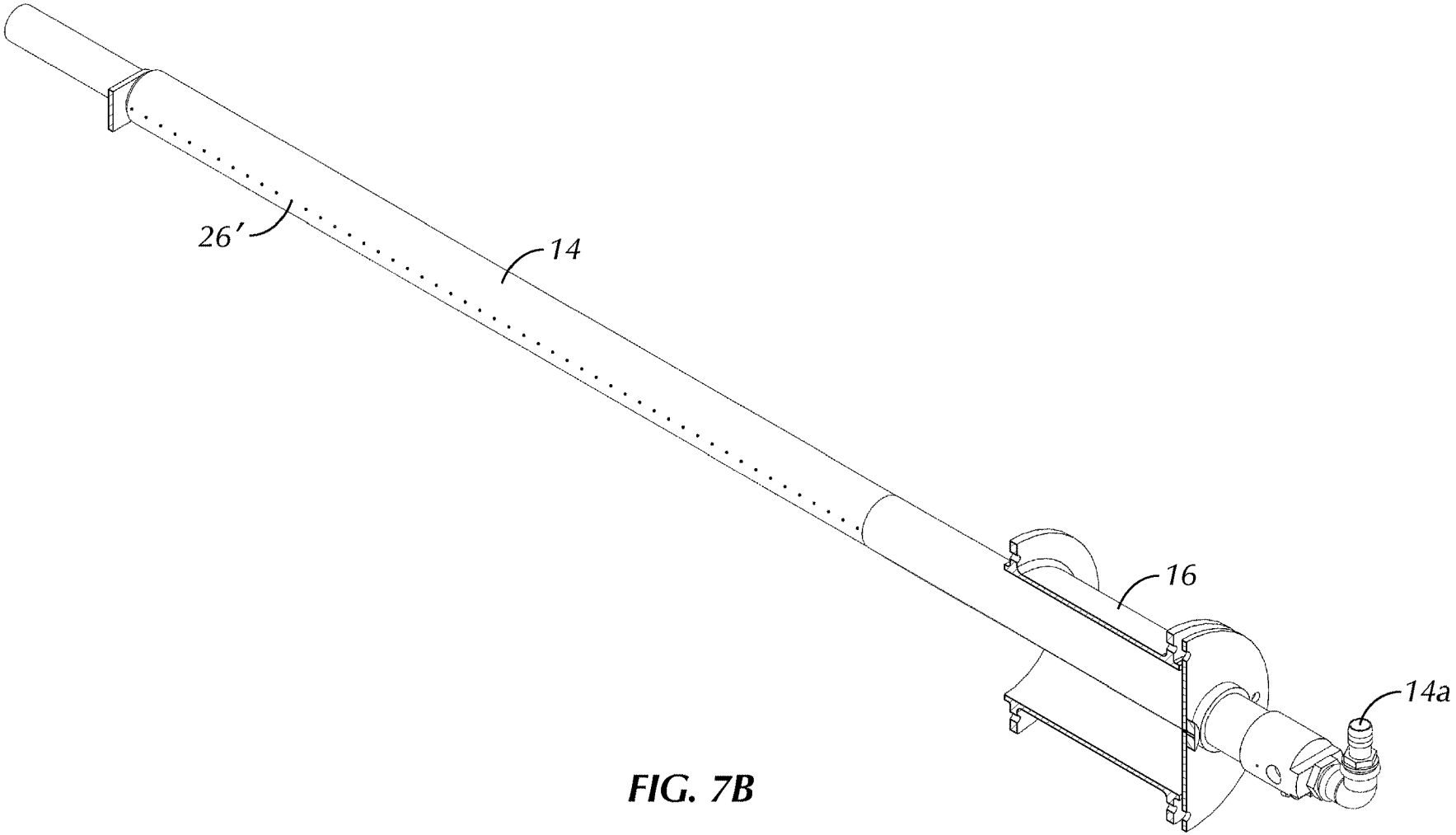
FIG. 7B is a cross-sectional perspective view of an alternative configuration of the burner of FIG. 1, taken along sectional line 7-7 of FIG. 1.

Turning to the second pipe 14, and referring to FIGS. 2, 7A and 7B, the second pipe 14 defines an internal diameter D14 of between approximately 20 mm (0.75 inch IPS) and approximately 50 mm (2 inch IPS). As shown best in FIG. 7A, the second pipe 14 may take the form of a ribbon burner, having a ribbon 26 laterally extending from, or embedded in a side wall of, the second pipe 14 along a portion of the length of the second pipe 14 in a manner well understood by those of ordinary skill in the art. As should be understood by those of ordinary skill in the art, the ribbon 26 includes a plurality of ported and/or meshed and stacked, laterally oriented ribbon strips (not shown), e.g., constructed of steel, therein (not shown), forming a lattice of apertures/channels therebetween. The strips generally extend the length of the ribbon 26. As also should be understood by those of ordinary skill in the art, the ribbon 26 may define any internal pattern of the ported and/or meshed and stacked ribbon strips, currently known or that later becomes known. Alternatively, and as shown best in FIG. 7B, the second pipe 14 may include a plurality of apertures 26' formed in the sidewall of the second pipe 14 (replacing or supplementing the ribbon 26), e.g., laser or EDM cut, drilled or the like, and positioned along a portion of the length of the second pipe 14. In one configuration, the length of the ribbon 26 (or the collective span of the apertures 26') may correspond to the flame space of the first pipe 12. That is, the length of the ribbon 26 (or the collective span of the apertures 26') may be substantially equal to the portion of the first pipe 12 having the apertures 12*a*. In one configuration, the ribbon 26 may project in substantially the same plane as the apertures 12*a*.

The second pipe 14 may be connected to an air-only source 4 (shown schematically in FIG. 1) via a connection fitting 14*a* at an inlet, e.g., at a proximal end, of the second pipe 14. For example, the second pipe 14 may release between approximately 2.37 $m^3$/hr (83.6 $ft^3$/hr) and approximately 42.04 $m^3$/hr (1,484 $ft^3$/hr) of excess air into the oven chamber 1. The second pipe 14, releasing only air (via the ribbons 26 or the apertures 26'), may be employed to assist in reduction of nitrogen oxides. That is, the second pipe 14, positioned on an opposite side of the first pipe 12 from the apertures 12*a*, may release air to substantially envelope the first pipe 12. Nitrogen oxides are generally produced from the reaction of nitrogen and oxygen gases in the air during combustion, especially at high temperatures. In operation of the of the burner 10, release of air from the second pipe 14 may assist in cooling the flame along the apertures 12*a*, thereby reducing nitrogen oxide formation. Release of air from the second pipe 14 may also assist with the hydrogen gas combustion process, e.g., maintaining an appropriate volume of air within the oven chamber 1.

Figure 8:
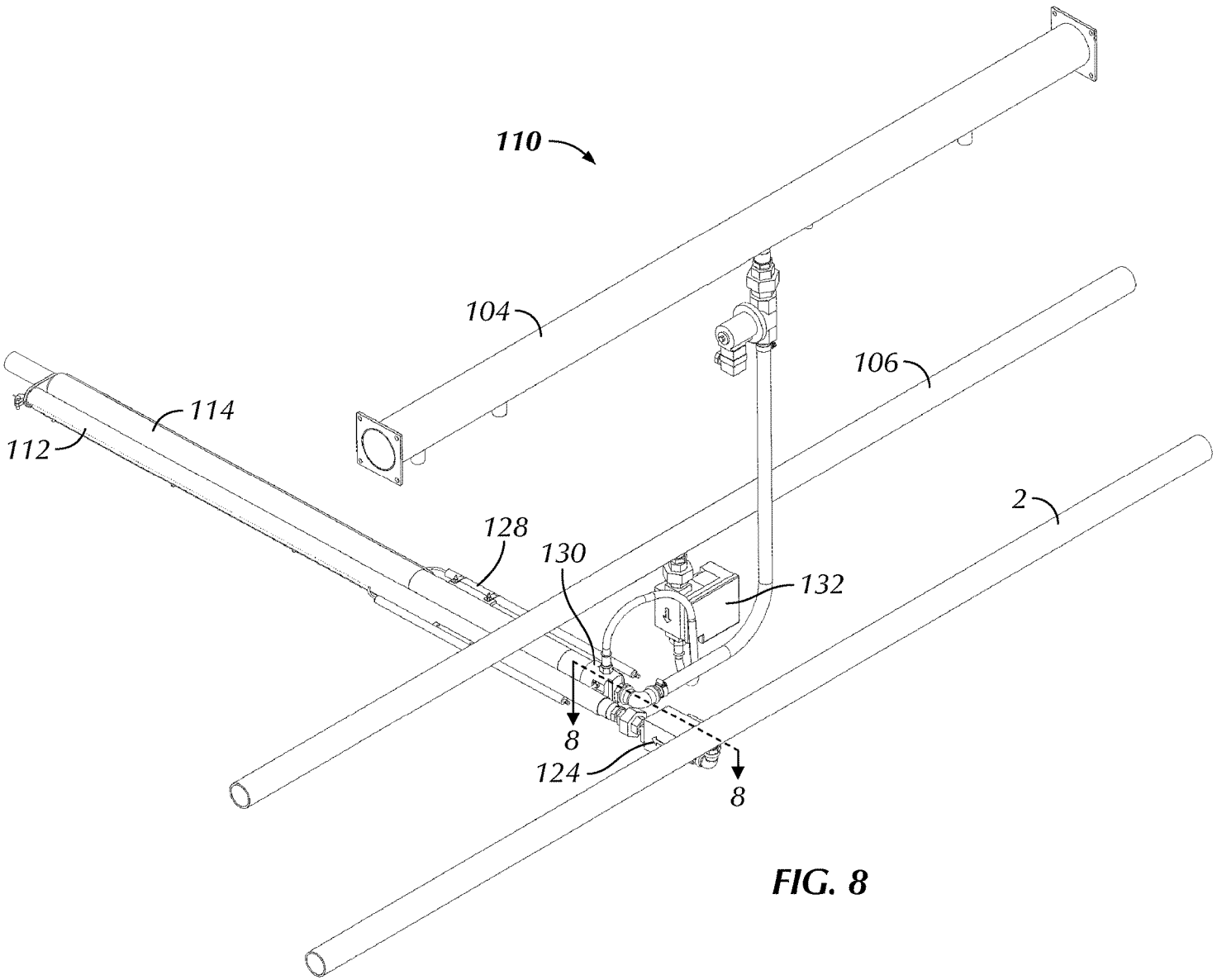
FIG. 8 is a top, front and proximal perspective view of a gas burner assembly for use with a direct, indirect or hybrid fired oven, according to a second embodiment of the present disclosure.
Figure 9:
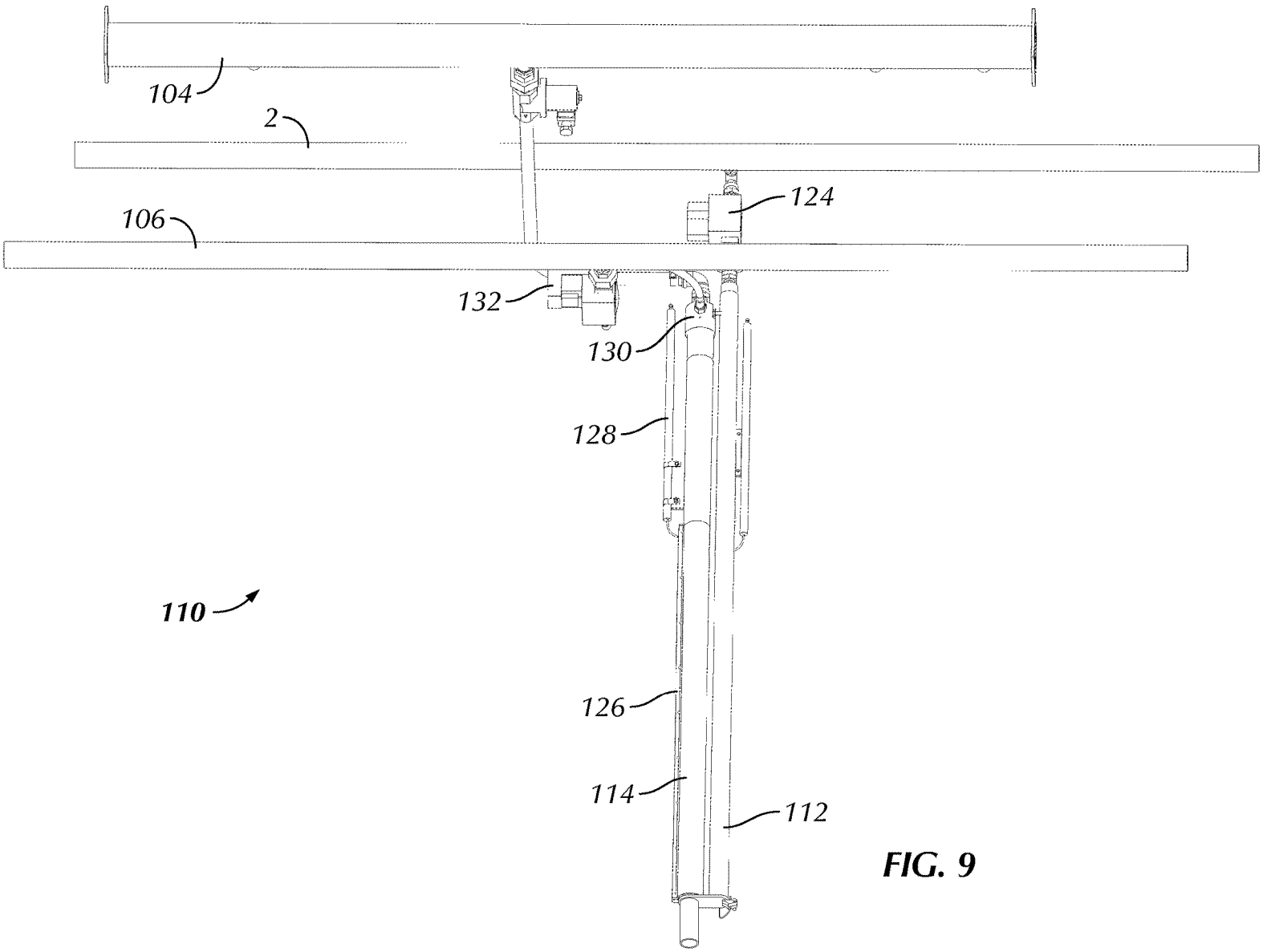
FIG. 9 is a top and distal perspective view of the burner assembly of FIG. 8.
Figure 10:
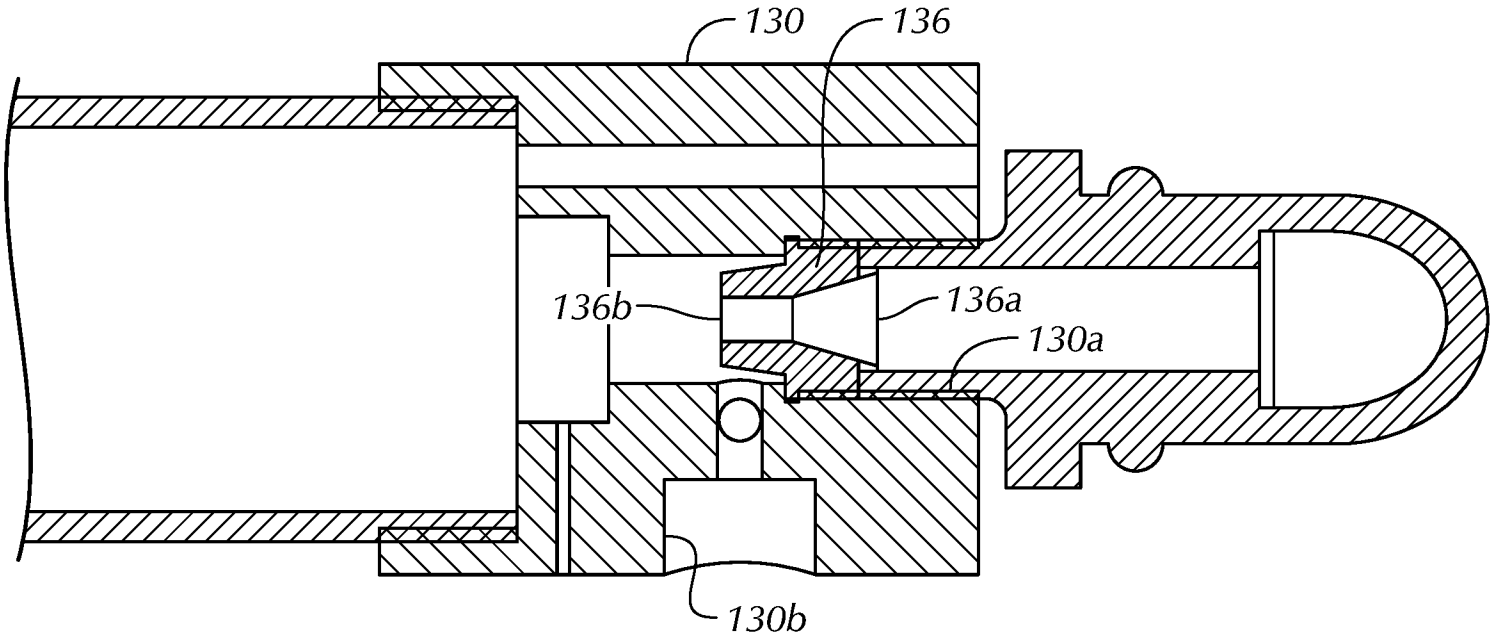
FIG. 10 is a partial, cross-sectional plan view of the burner of FIG. 8, taken along sectional line 8-8 of FIG. 8.

FIGS. 8-10 illustrate a second embodiment of a burner for use with a direct, indirect or hybrid fired oven. The reference numerals of the second embodiment are distinguishable from those of the above-described first embodiment by a factor of one hundred (100), but otherwise indicate the same elements as indicated above, except as otherwise specified. The burner 110 of the present embodiment is similar to that of the earlier embodiment. Therefore, the description of certain similarities and modes of operation between the embodiments may be omitted herein for the sake of brevity and convenience, and, therefore, is not limiting.

A primary difference of the burner 110 over the burner 10 is the selective operability of the second pipe 114 as a fuel gas burner. The fuel gas operating as the energy source for the second pipe 114 may take the form of, for example, natural gas, a mixed blend of natural gas and hydrogen gas, propane or a mixed blend of propane and hydrogen gas. For the sake of brevity, the following description recites the use of natural gas or a mixed blend of natural gas and hydrogen gas as the fuel gas for the second pipe 114, but the second pipe 114 may equally be operable with other fuel gases, such as, for example, the other fuel gasses previously identified.

As shown best in FIG. 9, the second pipe 114 is oriented such that the ribbon 126 faces away from the first pipe 112. That is, second pipe 114 is rotated substantially 180° from the second pipe 14 of FIGS. 1-7B. The burner assembly 110 includes a second igniter 128 (controlled via a direct spark ignition (not shown)) connected to, or positioned adjacent, the ribbon 126 of the second pipe 114 in a manner well understood by those of ordinary skill in the art and configured to provide an electrical spark to the ribbon 126. As shown, the second igniter 128 extends substantially parallel to the second pipe 112 and is positioned proximate a proximal end of the second pipe 114. In the illustrated configuration, the second igniter 128 is positioned in the same plane as the ribbon 126, but the disclosure is not so limited. Similarly to the first and second pipes 112, 114, the second igniter 128 may extend through the mounting spool pipe (not shown) and may be secured by the mounting plates (not shown), but the disclosure is not so limited. As should be understood by those of ordinary skill in the art, the second igniter 128 may also take the form of a conventional combination igniter and flame detection sensor.

A mixing valve 130 is connected to an inlet, e.g., at a proximal end, of the second pipe 114. As should be understood by those of ordinary skill in the art, the mixing valve 130 is fluidly connected with a source of air 104 (via air inlet 130*a*—see FIG. 10) and with a source of natural gas, or a natural gas and hydrogen gas blend, 106 (via gas inlet 130*b*—see FIG. 10). Natural gas and hydrogen gas may be premixed, for example, into a blend having between approximately 10% and approximately 70% hydrogen gas (i.e., the remaining percentage being natural gas), such as, for example, without limitation, approximately 50% hydrogen gas.

The mixing valve 130 mixes the air and natural gas (or air and natural gas/hydrogen gas blend) together according to a predetermined ratio (of air to natural gas according to the percentage of natural gas present) and fluidly connects the mixed air and natural gas (or mixed air and natural gas/hydrogen gas blend) with the second pipe 114 in a manner well understood by those of ordinary skill in the art. A combination valve and zero-pressure regulator 132, e.g., without limitation a Honeywell model number VK4125V2029 C series combination valve, zero regulator, and ignition system, may be employed in line between the source of natural gas (or natural gas/hydrogen gas blend) 106 and the mixing valve 130. As should be understood by those of ordinary skill in the art, the gas valves (not shown), e.g., solenoid valves, within the combination gas valve and zero-pressure regulator 132 regulate, i.e., selectively permit or prohibit, the flow of natural gas (or natural gas/hydrogen gas blend) from the natural gas (or natural gas/hydrogen gas blend) source 106 to the mixing valve 130. The zero-pressure regulator (not shown) within the combination gas valve and zero-pressure regulator 132 selectively allows the flow of natural gas (or natural gas/hydrogen gas blend) from the natural gas (or natural gas/hydrogen gas blend) source 106, through the combination gas valve and zero-pressure regulator 132, and to the gas inlet 130*b* of the mixing valve 130 upon generation of a venturi (see FIG. 10), i.e., a vacuum, created by the flow of air through the mixing valve 130 via the air inlet 130*a*.

In one configuration, as shown in FIG. 10, the air inlet 130*a* of the mixing valve 130 may include (therein, or adjacent thereto, and upstream of or proximate to the gas inlet 130*b*) an airflow nozzle 136 therein, to set the maximum amount of air mixing with the natural gas (or natural gas/hydrogen gas blend) and subsequently entering the second pipe 114. As shown, the nozzle 136 defines an inlet opening 136*a* and an outlet opening 136*b* (according to the direction of flow into the second pipe 114). In the illustrated embodiment, the inner diameter of the airflow nozzle 136 generally tapers from a wider inlet opening 136*a* to a narrower outlet opening 136*b*. The diameter of the outlet opening 136*b* is selected relative to the maximum amount of air required to mix with natural gas (or natural gas/hydrogen gas blend) and enter into the second pipe 114 to achieve the intended thermal output of the burner 110 when operated as a natural gas (or natural gas/hydrogen gas blend) burner. The calibrated diameter of the outlet opening 136*b*, in combination with the pressure of the air, determines the flow rate of the subsequently mixed air and natural gas (or natural gas/hydrogen gas blend) entering the second pipe 114, i.e., according to Bernoulli's equation. In one configuration, the outlet opening 136*b* of the nozzle 136 may define a diameter between approximately 0.118 inch (3 mm) and approximately 0.98 inch (25 mm) depending on the maximum flow rate for the particular length of the second pipe 114, such as, for example, without limitation, approximately 0.196 inch (5 mm).

In one configuration, the second pipe 114 may be selectively rotatable e.g., manually or through an automated process, about a central axis thereof, such that the ribbon 126 may be selectively oriented as shown in FIGS. 8, 9 or as shown in FIGS. 1-3 and 7A. This allows an oven to be readily converted between a hydrogen burner oven and a natural gas (or natural gas/hydrogen gas blend) burner oven. One example of when this would be desired is if the supply of hydrogen becomes reduced or exhausted for some reason, the oven could be quickly converted over to natural gas (or natural gas/hydrogen gas blend) oven. A second example is if there is no hydrogen supply available when the oven is initially built, but it is expected to be available in the future. The oven could be initially set to burn natural gas and then switched over to hydrogen gas when the hydrogen becomes available.

More specifically, in operation, the first pipe 112 of the burner 110 may be selectively operated as a hydrogen gas burner as previously described with respect to the burner 10. In such operation, the second pipe 114 may be rotated such that the ribbon 126 faces the first pipe 112 (like the second pipe 14), and the second pipe 114 may receive only air and operate as previously described with respect to the second pipe 14 of the embodiment of FIGS. 1-7B. For example, the gas valves within the combination gas valve and zero-pressure regulator 132 may be closed to prohibit the flow of natural gas (or a natural gas/hydrogen gas blend) to the second pipe 114, such that only air from the air source 104 may be delivered to the second pipe 114 (via the mixing valve 130). The second pipe 114 may then be operated to release air to substantially envelope the first pipe 112 during operation of the first pipe 112 as a hydrogen gas burner and to maintain an appropriate volume of air within the oven chamber.

The second pipe 114 may also be selectively operated as a natural gas (or a natural gas/hydrogen gas blend) burner, e.g., in the absence or reduced availability of hydrogen gas. In such operation, the second pipe 114 may be rotated such that the ribbon 126 faces away from the first pipe 112 (as shown in FIGS. 8, 9). In such operation, the gas valve(s) (not shown) within the combination gas valve and pressure regulator 124 may be closed, preventing gas from flowing into the first pipe 112. The second pipe 114 may then be operated as a natural gas (or natural gas/hydrogen gas blend) burner in a manner well understood by those of ordinary skill in the art. That is, generally, the mixing valve 130 mixes the air and natural gas (or natural gas/hydrogen gas blend) together according to a predetermined ratio or air to natural gas and fluidly connects the mixed air and natural gas (or air and natural gas/hydrogen gas blend) with the second pipe 114. The mixed air and natural gas (or air and natural gas/hydrogen gas blend) then flows out of the second pipe 114 through the ribbon 126 and ignited by the second igniter 128 to light a flame. In one configuration, the second pipe 114 may be fluidly connected with the aforementioned upstream components via flexible conduits, hoses, swivel union or the like, in order to permit simplified rotation of the second pipe 114.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure, as set forth in the appended claims.

We claim:

1. A hydrogen gas burner comprising:

a first pipe extendable into an oven chamber, the first pipe including a sidewall defining a plurality of discrete through-holes formed therethrough and along a portion of a length of the sidewall, the through-holes fluidly communicating an interior of the first pipe with an exterior thereof;

a combination gas valve and pressure regulator connected to an inlet of the first pipe, the combination gas valve and pressure regulator being configured to fluidly connect a source of hydrogen gas with the interior of the first pipe at a predetermined positive pressure, such that the hydrogen gas flows into the first pipe from the inlet thereof and exits out of the first pipe through the plurality of through-holes;

an igniter configured to provide an electrical spark adjacent at least one of the plurality of through-holes, and, in turn, ignite and initiate combustion of the hydrogen gas exiting from the plurality of through-holes; and a second pipe extendable into the oven chamber, the second pipe having a plurality of apertures along a portion of a length of a sidewall thereof and fluidly communicating an interior of the second pipe with an exterior thereof, the second pipe being configured to fluidly connect at an inlet thereof with a source of air, such that the air flows into the second pipe from the inlet thereof and exits out of the second pipe through the apertures.

2. The burner of claim 1, wherein the first pipe and the second pipe are coplanar and extend parallel to one another.

3. The burner of claim 1, wherein the second pipe is positioned on an opposite side of the first pipe from the plurality of through-holes, and the apertures face toward the first pipe.

4. The burner of claim 1, wherein the apertures are coplanar with the plurality of through-holes.

5. The burner of claim 1, wherein the apertures span a length substantially equal to the portion of the length of the first pipe having the plurality of through-holes.

6. The burner of claim 1, wherein the second pipe includes a ribbon along the portion of the length of the sidewall thereof, the ribbon defining the apertures.

7. The burner of claim 1, wherein at least one of the first pipe and the second pipe is substantially cylindrical.

8. The burner of claim 1, wherein the plurality of through-holes are arranged in at least one row along the portion of the length of the first pipe.

9. The burner of claim 1, wherein the plurality of through-holes are arranged in a single row along the portion of the length of the first pipe.

10. A gas burner comprising:

a first pipe extendable into an oven chamber, the first pipe including a sidewall defining a plurality of discrete through-holes formed therethrough and along a portion of a length of the sidewall, the through-holes fluidly communicating an interior of the first pipe with an exterior thereof;

a combination gas valve and pressure regulator connected to an inlet of the first pipe, the combination gas valve and pressure regulator being configured to selectively, fluidly connect a source of hydrogen gas with the interior of the first pipe at a predetermined positive pressure to selectively permit the hydrogen gas to flow into the first pipe from the inlet thereof and exit out of the first pipe through the plurality of through-holes;

a first igniter configured to selectively provide an electrical spark adjacent at least one of the plurality of through-holes, and, in turn, selectively ignite and initiate combustion of the hydrogen gas exiting from the plurality of through-holes;

a second pipe extendable into the oven chamber, the second pipe having a ribbon extending along a portion of a length thereof and fluidly communicating an interior of the second pipe with an exterior thereof, a mixing valve connected to an inlet of the second pipe, the mixing valve being configured to receive air from a source of air, selectively receive a fuel gas from a source of the fuel gas, selectively mix the air and the fuel gas together and selectively, fluidly connect the mixed air and fuel gas with the interior of the second pipe such that the mixed air and fuel gas flows into the second pipe from the inlet thereof and exits out of the second pipe through the ribbon; and a second igniter configured to selectively provide an electrical spark adjacent the ribbon, and, in turn, selectively ignite and initiate combustion of the mixed air and fuel gas exiting from the ribbon.

11. The burner of claim 10, wherein the second pipe is positioned on an opposite side of the first pipe from the plurality of through-holes, and the ribbon faces away from the first pipe.

12. The burner of claim 10, further comprising a combination gas valve and zero-pressure regulator in fluid communication with an inlet of the mixing valve, the combination gas valve and zero-pressure regulator configured to selectively permit or prohibit flow of the fuel gas from the source of the fuel gas to the mixing valve.

13. The burner of claim 10, wherein the fuel gas comprises natural gas, a mixed blend of natural gas and hydrogen gas, propane or a mixed blend of propane and hydrogen gas.

14. A gas burner comprising:

a first pipe extendable into an oven chamber, the first pipe including a plurality of through-holes in a sidewall thereof and along a portion of a length thereof, fluidly communicating an interior of the first pipe with an exterior thereof;

a combination gas valve and pressure regulator connected to an inlet of the first pipe, the combination gas valve and pressure regulator being configured to selectively, fluidly connect a source of hydrogen gas with the interior of the first pipe at a predetermined pressure to selectively permit the hydrogen gas to flow into the first pipe from the inlet thereof and exit out of the first pipe through the plurality of through-holes;

a first igniter configured to selectively provide an electrical spark adjacent at least one of the plurality of through-holes, and, in turn, selectively ignite and initiate combustion of the hydrogen gas exiting from the plurality of through-holes;

a second pipe extendable into the oven chamber, the second pipe having a ribbon extending along a portion of a length thereof and fluidly communicating an interior of the second pipe with an exterior thereof, the second pipe being rotatable about a central axis thereof between a first position and a second position, wherein, in the first position, the ribbon faces the first pipe, and in the second position, the ribbon faces away from the first pipe;

a mixing valve connected to an inlet of the second pipe, the mixing valve being configured to receive air from a source of air in the first position of the second pipe and fluidly connect the air with the interior of the second pipe, such that the air flows into the second pipe from the inlet thereof and exits out of the second pipe through the ribbon, and the mixing valve being configured to receive air from the source of air and receive a fuel gas from a source of the fuel gas in the second position of the second pipe, mix the air and the fuel gas together and direct the mixed air and fuel gas into the interior of the second pipe such that the mixed air and fuel gas flows into the second pipe from the inlet thereof and exits out of the second pipe through the ribbon; and a second igniter configured to provide an electrical spark adjacent the ribbon in the second position of the second pipe, and, in turn, selectively ignite and initiate combustion of the mixed air and fuel gas exiting from the ribbon.

15. The burner of claim 14, wherein the first pipe and the second pipe are coplanar and extend parallel to one another.

16. The burner of claim 14, wherein the plurality of through-holes are arranged in at least one row along the portion of the length of the first pipe.

17. The burner of claim 14, wherein the second pipe is positioned on an opposite side of the first pipe from the plurality of through-holes.

18. The burner of claim 14, wherein the ribbon is substantially equal in length to the portion of the length of the first pipe having the plurality of through-holes.

19. The burner of claim 14, further comprising a combination gas valve and zero-pressure regulator in fluid communication with an inlet of the mixing valve, the combination gas valve and zero-pressure regulator configured to prohibit flow of the fuel gas from the source of the fuel gas to the mixing valve in the first position of the second pipe and configured to permit the flow of the fuel gas from the source of the fuel gas to the mixing valve in the second position of the second pipe.

20. The burner of claim 14, wherein the fuel gas comprises natural gas, a mixed blend of natural gas and hydrogen gas, propane or a mixed blend of propane and hydrogen gas.

* * * * *